US009506613B2

(12) United States Patent
Iwasaki

(10) Patent No.: US 9,506,613 B2
(45) Date of Patent: Nov. 29, 2016

(54) VEHICLE LAMP FITTING

(71) Applicant: Ichikoh Industries, Ltd., Kanagawa (JP)

(72) Inventor: Kazunori Iwasaki, Kanagawa (JP)

(73) Assignee: Ichikoh Industries, Ltd., Kanagawa (JP)

( * ) Notice: Subject to any disclaimer, the term of this patent is extended or adjusted under 35 U.S.C. 154(b) by 35 days.

(21) Appl. No.: 13/852,928

(22) Filed: Mar. 28, 2013

(65) Prior Publication Data

US 2013/0294102 A1 Nov. 7, 2013

(30) Foreign Application Priority Data

Mar. 30, 2012 (JP) ..... 2012-082361

(51) Int. Cl.
*F21V 5/00* (2015.01)
*F21S 8/10* (2006.01)

(52) U.S. Cl.
CPC ..... *F21S 48/1225* (2013.01); *F21S 48/1154* (2013.01); *F21S 48/1266* (2013.01)

(58) Field of Classification Search
CPC ..... F21S 48/1258; F21S 48/225; F21S 48/1291; F21S 48/1241; F21S 48/125; F21S 48/1159; F21S 48/1266; B60Q 1/16; B60Q 1/24; G02B 3/02; G02B 3/04; G02B 3/10; G02B 19/0061; G02B 19/0047; B62J 6/02; F21V 5/045; F21V 5/08
USPC ..... 362/509, 520, 522, 507, 311.02, 362/311.06, 311.1, 521, 307–309, 326, 331, 362/334, 335, 340
See application file for complete search history.

(56) References Cited

U.S. PATENT DOCUMENTS

| | | | | |
|---|---|---|---|---|
| 3,743,385 | A * | 7/1973 | Schaefer | 359/718 |
| 6,821,008 | B2 * | 11/2004 | Tokoro et al. | 362/539 |
| 2007/0047248 | A1 * | 3/2007 | Tsukamoto et al. | 362/520 |
| 2007/0127253 | A1 * | 6/2007 | Kawashima et al. | 362/509 |
| 2007/0291499 | A1 * | 12/2007 | Tanaka | 362/509 |
| 2009/0154185 | A1 * | 6/2009 | Yagi | F21S 48/1154 362/516 |

(Continued)

FOREIGN PATENT DOCUMENTS

| | | | |
|---|---|---|---|
| DE | 19549128 | A1 | 8/1996 |
| DE | 102004024107 | A1 | 12/2005 |
| EP | 2610546 | A2 | 3/2013 |

(Continued)

OTHER PUBLICATIONS

European Search Report, dated Mar. 2, 2015, for European Application No. 13160817.6, 7 pages.

(Continued)

*Primary Examiner* — Jong-Suk (James) Lee
*Assistant Examiner* — Erin Kryukova
(74) *Attorney, Agent, or Firm* — Kinney & Lange, P.A.

(57) ABSTRACT

A vehicle lamp fitting comprises a semiconductor light source and a lens adapted to radiate light from the semiconductor light source with both a main light distribution pattern and an overhead sign light distribution pattern. The lens includes a first surface of incidence adapted to form the main light distribution pattern, and a second surface of incidence adapted to form the overhead sign light distribution pattern. The second surface of incidence is located further to a side of the lens adjacent to the semiconductor light source than an imaginary first surface of incidence.

6 Claims, 4 Drawing Sheets

(56) References Cited

U.S. PATENT DOCUMENTS

2012/0243250 A1* 9/2012 Yagi ..... 362/520
2013/0027961 A1 1/2013 Ugajin

FOREIGN PATENT DOCUMENTS

JP 2008103192 A 1/2008
JP 2008066252 A 3/2008
JP 2008300154 A 11/2008
JP 2010277818 A 12/2010

OTHER PUBLICATIONS

The First Office Action from the Chinese Patent Office for Chinese Application No. 201310099299.6, dated Sep. 29, 2014, 5 pages.
The Second Office Action from the Chinese Patent Office for Chinese Application No. 201310099299.6, dated May 29, 2015, 7 pages.

* cited by examiner

VEHICLE LAMP FITTING

TECHNICAL FIELD

The present invention relates to a vehicle lamp fitting whereby light from a semiconductor light source is caused to enter a lens and can be radiated from the lens as a main light distribution pattern and an overhead sign light distribution pattern.

BACKGROUND OF THE INVENTION

This is a known type of vehicle lamp fitting (for example Japanese Patent Kokai 2010-277818, Japanese Patent Kokai 2008-66252). A conventional vehicle lamp fitting will now be described.

The conventional vehicle lamp fitting of Japanese Patent Kokai 2010-277818 comprises a light-emitting element, a projection lens which radiates light from the light-emitting element as a diffused type light distribution pattern, and a reflector which radiates light from the light-emitting element as a light distribution pattern for overhead signs.

The conventional vehicle lamp fitting of Japanese Patent Kokai 2008-66252 is a projector-type headlamp comprising a light-source bulb, a reflector which reflects light from the light-source bulb, and a lens which radiates light from the reflector as a generic light distribution pattern and as a light distribution pattern for overhead signs.

SUMMARY OF THE INVENTION

However, since the conventional vehicle lamp fitting of Japanese Patent Kokai 2010-277818 requires a reflector, the number of components and the number of assembly steps is increased, the manufacturing cost is high, and the size is increased, and it is difficult for layout flexibility to be improved. The conventional vehicle lamp fitting of Japanese Patent Kokai 2008-66252 is a projector-type headlamp employing a light-source bulb, and it is thus large in comparison with a direct-radiation lens type lamp unit employing a semiconductor light source, it is difficult for layout flexibility to be improved, and the manufacturing cost is high.

The problems to be resolved by the invention are that with a conventional vehicle lamp fitting the manufacturing cost is high and it is difficult for layout flexibility to be improved.

According to a first aspect of the present invention there is provided a semiconductor light source and a lens adapted to radiate light from the semiconductor light source with both a main light distribution pattern and an overhead sign light distribution pattern. The lens includes a first surface of incidence adapted to form the main light distribution pattern, and a second surface of incidence adapted to form the overhead sign light distribution pattern. The second surface of incidence is located further to a side of the lens adjacent to the semiconductor light source than an imaginary first surface of incidence. Optionally, a distance between the second surface of incidence and the imaginary first surface of incidence can increase with increasing distance from the first surface of incidence.

Preferably, the second surface of incidence is located above the first surface of incidence.

ADVANTAGES OF THE INVENTION

With the vehicle lamp fitting of the present invention, the manufacturing cost can be lowered and improved layout flexibility can be achieved.

BRIEF DESCRIPTION OF THE FIGURES

Embodiments of the present invention will now be described by way of further example only and with reference to the accompanying drawings, in which.

DETAILED DESCRIPTION

Figure 6:
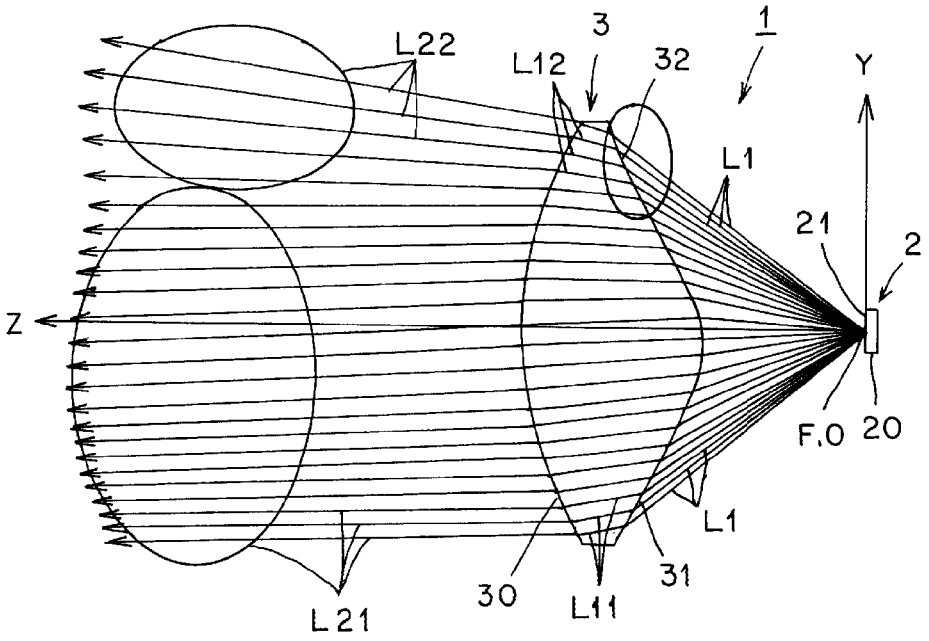
FIG. 6 is an explanatory view illustrating the path of light which is emitted by the semiconductor light source and passes through the lens.
Figure 7:
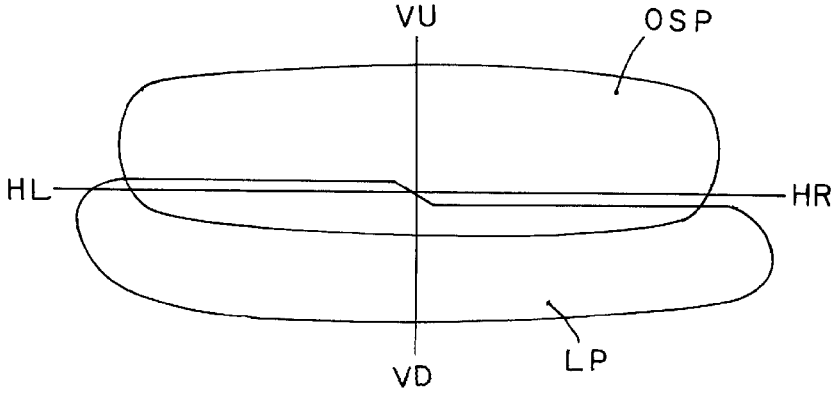
FIG. 7 is an explanatory view illustrating a low-beam light distribution pattern, which constitutes the main light distribution pattern, and the overhead sign light distribution pattern.

An exemplary embodiment of the vehicle lamp fitting according to the present invention will now be described in detail with reference to the figures. It should be noted that the present invention is not limited by this embodiment. In FIG. 7, the reference code 'VU-VD' indicates a vertical up-down line on a screen. The reference code 'HL-HR' indicates a horizontal left-right line on a screen. Further, in FIG. 5 and FIG. 6 the hatching in the cross-section of the lens is omitted. In this specification, the terms front, rear, up, down, left, right refer to front, rear, up, down, left, right when the vehicle lamp fitting according to the present invention is installed in a vehicle.

(Description of the Configuration of the Embodiment)

Figure 1:
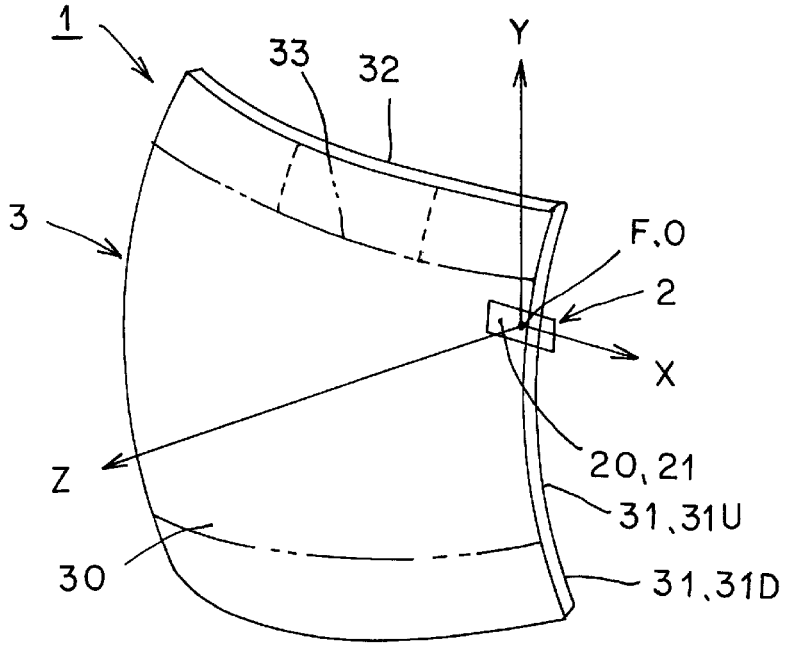
FIG. 1 is a perspective view of a semiconductor light source and a lens, illustrating an embodiment of the vehicle lamp fitting according to the present invention.

The configuration of the vehicle lamp fitting according to the present embodiment will now be described. In FIG. 1, the reference sign 1 is the vehicle lamp fitting according to the present embodiment (for example a headlamp or the like). The vehicle lamp fitting 1 is installed at the left and right edges of the front portion of a vehicle (which is not shown in the drawings).

(Description of Lamp Unit)

Figure 3:
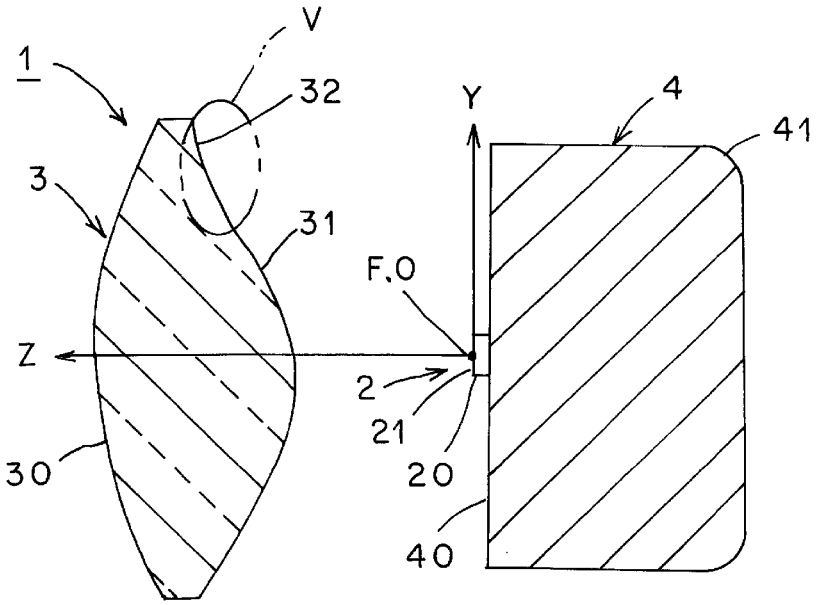
FIG. 3 is a sectional view taken along line III-III in FIG. 2.
Figure 4:
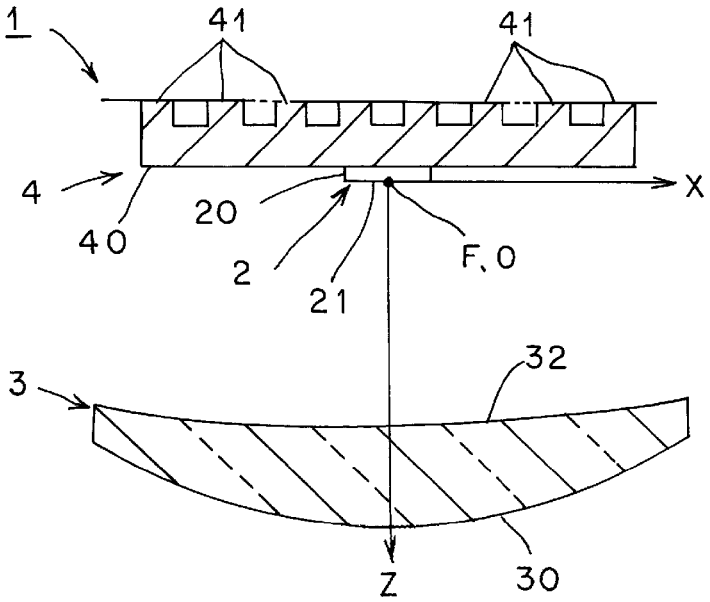
FIG. 4 is a sectional view taken along line IV-IV in FIG. 2.

As shown in FIG. 3 and FIG. 4, the vehicle lamp fitting 1 comprises a lamp housing (which is not shown in the drawings), a lamp lens (which is not shown in the drawings), a semiconductor light source 2, a lens 3, and a heat sink member combined with an attachment member (referred to as 'heat sink member' hereinbelow) 4.

The semiconductor light source 2, the lens 3 and the heat sink member 4 form a lamp unit. The lamp housing and the lamp lens define a lamp chamber (which is not shown in the drawings). The lamp unit 2, 3, 4 is disposed in the lamp chamber, and is attached to the lamp housing by means of an up-down direction optical axis adjusting mechanism (which is not shown in the drawings) and a left-right direction optical axis adjusting mechanism (which is not shown in the drawings).

(Description of Semiconductor Light Source 2)

As shown in FIG. 1 to FIG. 4 and FIG. 6, in the current example the semiconductor light source 2 is a self-luminous semiconductor light source such as an LED or an EL (organic EL) light source. The semiconductor light source 2 consists of a light-emitting chip (LED chip) 20, a package (LED package) in which the light-emitting chip 20 is sealed using a resin sealing member, a substrate (which is not shown in the drawings) on which the package is mounted, and a connector (which is not shown in the drawings) which is attached to the substrate and which supplies a current from a power supply (battery) to the light-emitting chip 20. The substrate is fixed to the heat sink member 4 by means of screws (which are not shown in the drawings). The semiconductor light source 2 is consequently fixed to the heat sink member 4.

The light-emitting chip 20 has a planar rectangular shape (planar oblong shape) and may comprise a plurality of square chips aligned in the X axis direction (horizontal direction, left-right direction). It should be noted that one rectangular chip or one square chip may equally be employed. The front surface of the light-emitting chip 20, in this example a rectangular front surface, constitutes a light emitting surface 21. The light-emitting surface 21 faces forward in the direction of the reference optical axis (reference axis) Z of the lens 3. The center O of the light-emitting surface 21 of the light-emitting chip 20 is located at or in the vicinity of the reference focal point F of the lens 3, and is located on or in the vicinity of the reference optical axis Z of the lens 3.

In FIG. 1 to FIG. 4 and FIG. 6, X, Y, Z constitute orthogonal coordinates (X-Y-Z orthogonal coordinate system). The X axis is the horizontal axis in the left-right direction passing through the center O of the light-emitting surface 21 of the light-emitting chip 20, and in the present embodiment the positive direction is toward the left and the negative direction is toward the right. Also the Y axis is the vertical axis in the up-down direction passing through the center O of the light-emitting surface 21 of the light-emitting chip 20, and in the present embodiment the positive direction is upward and the negative direction is downward. Further, the Z axis is the normal line (perpendicular line) which passes through the center O of the light-emitting surface 21 of the light-emitting chip 20, in other words an axis extending in the front-back direction orthogonal to the X axis and the Y axis, and in the present embodiment the positive direction is toward the front and the negative direction is toward the back.

(Description of Lens 3)

As shown in FIG. 1 to FIG. 6, the lens 3 has the reference optical axis Z and the reference focal point F. The lens 3 is fixed to the heat sink member 4. The lens 3 radiates light L1 from the semiconductor light source 2 toward the front of the vehicle as a main light distribution pattern, in the present embodiment the low-beam light distribution pattern shown in FIG. 7 (light distribution pattern for passing) LP, and as an overhead sign light distribution pattern OSP.

The lens 3 consists of a first surface of incidence 31 and a second surface of incidence 32 where light L1 from the semiconductor light source 2 enters the lens 3, and an emission surface 30 where incident light L11, L12 which has entered the lens 3 is emitted as emitted light L21, L22. The first surface of incidence 31 forms the low-beam light distribution pattern LP. The second surface of incidence 32 forms the overhead sign light distribution pattern OSP. The first surface of incidence 31 and the second surface of incidence 32 may be formed as one continuous surface, or may be formed as a surface which is divided into two or more segments.

The surfaces of incidence 31, 32 of the lens 3 consist of a free-form surface, a compound quadratic surface or an aspherical surface. The surfaces of incidence 31, 32 of the lens 3 have a convex shape which protrudes toward the semiconductor light source 2 side in the longitudinal section (vertical section) in FIG. 3, and have a concave shape which protrudes toward the side opposite the semiconductor light source 2 in the transverse section (horizontal section) in FIG. 4. The emission surface 30 of the lens 3 consists of a free-form surface or a compound quadratic surface. The emission surface 30 of the lens 3 has a convex shape which protrudes toward the side opposite the semiconductor light source 2 in the longitudinal section (vertical section) in FIG. 3 and the transverse section (horizontal section) in FIG. 4.

Figure 5:
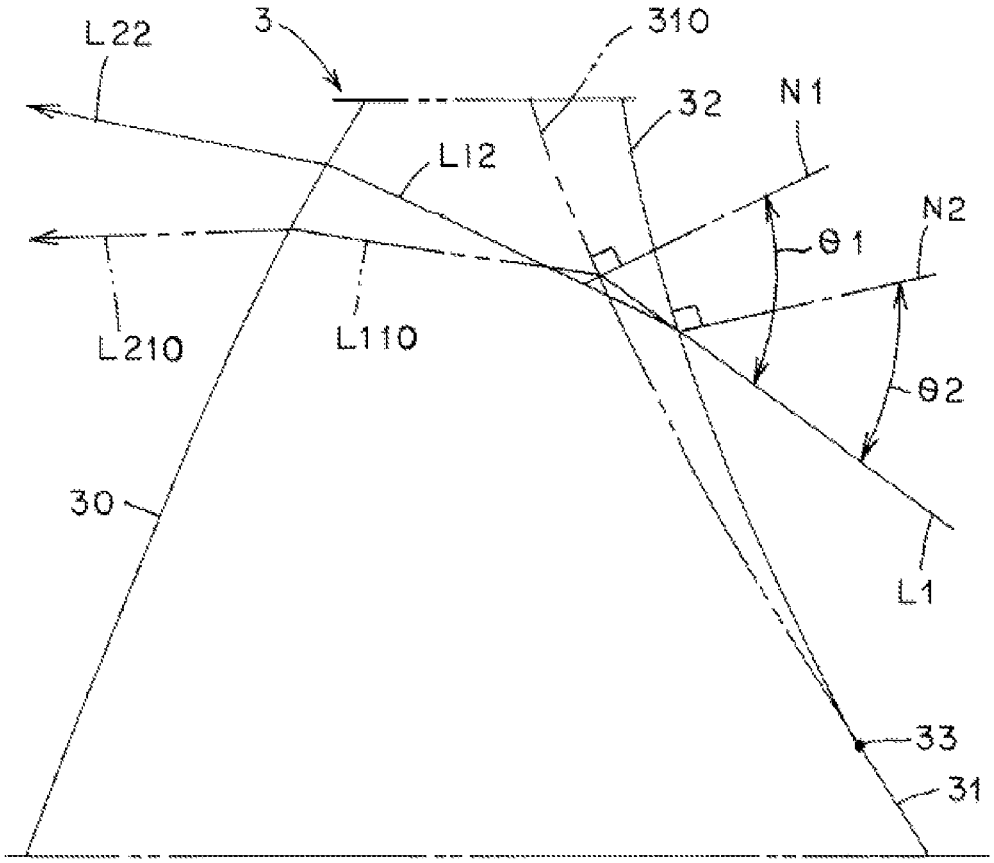
FIG. 5 is an enlarged sectional view of portion V in FIG. 3.

The second surface of incidence 32 lies further toward the semiconductor light source 2 side than the first surface of incidence 31 would if it were to be extended. In other words, as shown in FIG. 5, the second surface of incidence 32 is located on the semiconductor light source 2 side of an imaginary first surface of incidence 310 (see the two-dash chain line in FIG. 5) which is an extension of the first surface of incidence 31. Moreover, it is preferred that the distance between the second surface of incidence 32 and the imaginary first surface of incidence 310 increases with increasing distance from the first surface of incidence in the Y axis direction. In this way, the angle of incidence θ2 (referred to as 'second angle of incidence θ2' hereinbelow) at which light L1 from the semiconductor light source 2 enters the second surface of incidence 32 can be made smaller than the angle of incidence θ1 (referred to as 'first angle of incidence θ1' hereinbelow) at which light L1 from the semiconductor light source 2 enters the imaginary first surface of incidence 310. As a result, emitted light L22 (referred to as 'second emitted light L22' hereinbelow) which is emitted from the emission surface 30, being incident light L12 (referred to as 'second incident light L12' hereinbelow) which has entered the second surface of incidence 32, is emitted facing further upward than emitted light L210 (see the two-dash chain line in FIG. 5, referred to as 'first imaginary emitted light L210' hereinbelow) which would be emitted from the emission surface 30 if incident light L110 (see the two-dash chain line in FIG. 5, referred to as 'first imaginary incident light L110' hereinbelow) were to enter the imaginary first surface of incidence 310. This is therefore suitable for forming the overhead sign light distribution pattern OSP.

In FIG. 5, the reference code 'N1' indicates a normal line (referred to as 'first normal line' hereinbelow) at a location at which light L1 from the semiconductor light source 2 would enter the imaginary first surface of incidence 310. The angle between the first normal line N1 and the light L1 from the semiconductor light source 2 is the first angle of incidence θ1 at the imaginary first surface of incidence 310. Also, the reference code 'N2' indicates a normal line (referred to as 'second normal line' hereinbelow) at a location at which light L1 from the semiconductor light source 2 enters the second surface of incidence 32. The angle between the second normal line N2 and the light L1 from the semiconductor light source 2 is the second angle of incidence θ2 at the second surface of incidence 32.

The second surface of incidence 32 is located above the first surface of incidence 31. In other words, the second surface of incidence 32 is provided in a section of the surface of incidence of the lens 3 which is above a starting point (starting line) 33 (see the upper two-dash chain line in FIG. 1 and FIG. 2, and the circular black dot in FIG. 5). The starting point (starting line) 33 is the starting point (starting line) of the second surface of incidence 32 from the first surface of incidence 31, or the starting point (starting line) of the imaginary first surface of incidence 310 from the first surface of incidence 31. Thus light L1 from the semiconductor light source 2 which enters the second surface of incidence 32 is weaker than light L1 from the semiconductor light source 2 which enters in particular the central portion of the first surface of incidence 31. Also, the solid angle (which is not shown in the drawings) that the light-emitting surface 21 of the semiconductor light source 2 subtends at a point on the second surface of incidence 32 is smaller than the solid angle (which is not shown in the drawings) that the light-emitting surface 21 of the semiconductor light source 2 subtends at a point, in particular in the central portion, on the first surface of incidence 31. Thus the second incident light L12 which has entered the second surface of incidence 32 is suitable for forming the overhead sign light distribution pattern OSP.

Figure 2:
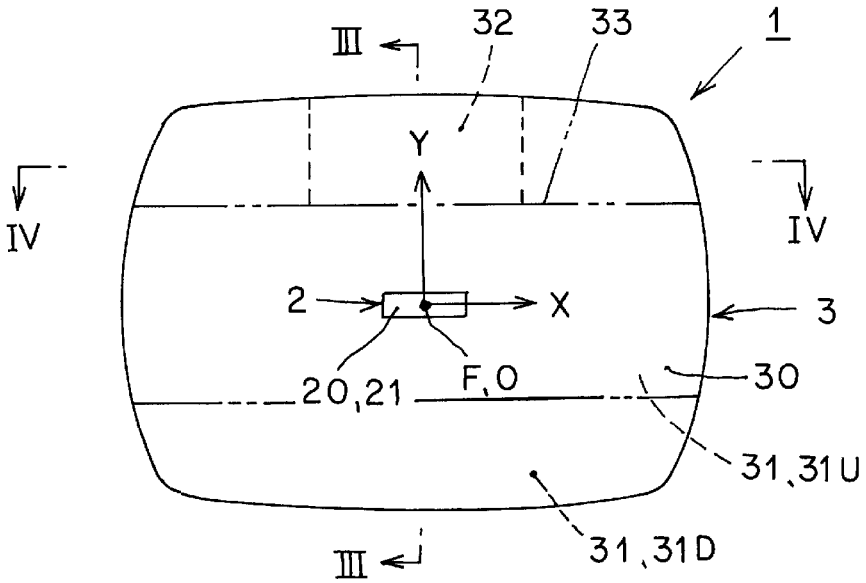
FIG. 2 is a front view illustrating the semiconductor light source and the lens.

The second surface of incidence 32 may be provided over the entire section of the surface of incidence of the lens 3 which is above the starting point (starting line) 33, or as shown by the dashed lines in FIG. 1 and FIG. 2, it may be provided in an intermediate portion of the surface of incidence of the lens 3 which is above the starting point (starting line) 33.

The first surface of incidence 31 is located below the second surface of incidence 32. In other words, the first surface of incidence 31 is provided on the surface of incidence of the lens 3 below the starting point (starting line) 33. The first surface of incidence 31 consists of an upper section 31U which is above the lower two-dash chain line in FIG. 1 and FIG. 2, and a lower section 31D which is below this lower two-dash chain line. In the first surface of incidence 31, the amount of light L1 from the semiconductor light source 2 which enters the lower section 31D is less than the amount of light L1 from the semiconductor light source 2 which enters upper section 31U. Also, the solid angle (which is not shown in the drawings) that the light-emitting surface 21 of the semiconductor light source 2 subtends at a point on the lower section 31D is smaller than the solid angle (which is not shown in the drawings) that the light-emitting surface 21 of the semiconductor light source 2 subtends at a point on the upper section 31U. In other words, the lower section 31D is further away from the semiconductor light source 2, and therefore the emitted image is smaller. On the other hand, the upper section 31U is closer to the semiconductor light source 2, and therefore the emitted image is larger. In this way, incident light L11 (referred to as 'first incident light L11' hereinbelow) which has entered the lower section 31D is suitable for forming a portion of the low-beam light distribution pattern LP comprising a light distribution pattern which is condensed narrowly in the vertical direction, as emitted light L21 (referred to as 'first emitted light L21' hereinbelow). On the other hand, incident light L11 (referred to as 'first incident light L11' hereinbelow) which has entered the upper section 31U is suitable for forming a portion of the low-beam light distribution pattern LP comprising a light distribution pattern which is diffused broadly in the vertical direction, as emitted light L21 (referred to as 'first emitted light L21' hereinbelow).

(Description of Heat Sink Member 4)

The heat sink member 4 allows heat generated by the semiconductor light source 2 to be radiated to the outside. The heat sink member 4 comprises for example an aluminum die-cast or resin member which is both thermally conductive and electrically conductive. As shown in FIG. 3 and FIG. 4, the heat sink member 4 consists of a vertical plate-shaped attachment portion 40 and a plurality of vertical plate-shaped fin portions 41 which are provided integrally on one surface (the rear surface, back surface) of the attachment portion 40.

The semiconductor light source 2 is fixed to a fixing surface on the other surface (the forward surface, front surface) of the attachment portion 40 of the heat sink member 4. The lens 3 is fixed to the heat sink member 4.

(Description of the Operation of the Embodiment)

The vehicle lamp fitting 1 according to the present embodiment is configured as described hereinabove, and its operation will now be described.

The semiconductor light source 2 is turned on. Light L1 from the semiconductor light source 2 then enters both the first surface of incidence 31 (31U, 31D) and the second surface of incidence 32 of the lens 3. First incident light L11 which has entered the first surface of incidence 31 (31U, 31D) is radiated from the emission surface 30 of the lens 3 toward the front of the vehicle as first emitted light L21. The first emitted light L21 illuminates for example the road surface in front of the vehicle as a low-beam light distribution pattern LP.

Here, first incident light L11 which has entered the upper section 31U of the first surface of incidence 31 illuminates for example the road surface in front of the vehicle as a portion of the low-beam light distribution pattern LP comprising a light distribution pattern which is diffused broadly in the vertical direction. Also, first incident light L11 which has entered the lower section 31D of the first surface of incidence 31 illuminates for example the road surface in front of the vehicle as a portion of the low-beam light distribution pattern LP comprising a light distribution pattern which is condensed narrowly in the vertical direction.

On the other hand, second incident light L12 which has entered the second surface of incidence 32 is radiated from the emission surface 30 of the lens 3 toward the front of the vehicle as second emitted light L22. The second emitted light L22 illuminates for example the road surface in front of the vehicle as an overhead sign light distribution pattern OSP.

(Description of the Advantages of the Embodiment)

The vehicle lamp fitting 1 according to the present embodiment is configured and operates as described hereinabove, and its advantages will now be described.

The vehicle lamp fitting 1 according to the present embodiment does not require a parabolic cylinder reflective surface in order to radiate the overhead sign light distribution pattern OSP, and therefore the number of components and the number of assembly steps can be reduced and the manufacturing cost can be lowered, and it is also possible to reduce the size and improve layout flexibility. Also, the vehicle lamp fitting 1 according to the present embodiment is not a projector-type headlamp employing a light-source bulb, but is a direct-radiation lens type lamp unit employing a semiconductor light source 2, and it is therefore possible to reduce the size and improve layout flexibility, and it is also possible to lower the manufacturing cost.

In the vehicle lamp fitting 1 according to the present embodiment, the second surface of incidence 32 is located on the semiconductor light source 2 side of an imaginary first surface of incidence 310 which is an extension of the first surface of incidence 31, and therefore the second angle of incidence θ2 at which light L1 from the semiconductor light source 2 enters the second surface of incidence 32 can be made smaller than the first angle of incidence θ1 at which light L1 from the semiconductor light source 2 enters the imaginary first surface of incidence 310. As a result, second emitted light L22 which is emitted from the emission surface 30, being second incident light L12 which has entered the second surface of incidence 32, is emitted facing further upward than first imaginary emitted light L210 which would be emitted from the emission surface 30 if first imaginary incident light L110 were to enter the imaginary first surface of incidence 310. This is therefore suitable for forming the overhead sign light distribution pattern OSP.

In the vehicle lamp fitting 1 according to the present embodiment, the second surface of incidence 32 is located above the first surface of incidence 31, and therefore light L1 from the semiconductor light source 2 which enters the second surface of incidence 32 is weaker than light L1 from the semiconductor light source 2 which enters in particular the central portion of the first surface of incidence 31. Also, the solid angle that the light-emitting surface 21 of the semiconductor light source 2 subtends at a point on the second surface of incidence 32 is smaller than the solid angle that the light-emitting surface 21 of the semiconductor light source 2 subtends at a point, in particular in the central portion, on the first surface of incidence 31. Thus the second incident light L12 which has entered the second surface of incidence 32 is suitable for forming the overhead sign light distribution pattern OSP.

In the vehicle lamp fitting 1 according to the present embodiment, in the first surface of incidence 31 the amount of light L1 from the semiconductor light source 2 which enters the lower section 31D is less than the amount of light L1 from the semiconductor light source 2 which enters upper section 31U. Also, the solid angle that the light-emitting surface 21 of the semiconductor light source 2 subtends at a point on the lower section 31D is smaller than the solid angle that the light-emitting surface 21 of the semiconductor light source 2 subtends at a point on the upper section 31U. In other words, the lower section 31D is further away from the semiconductor light source 2, and therefore the emitted image is smaller. On the other hand, the upper section 31U is closer to the semiconductor light source 2, and therefore the emitted image is larger. In this way, first incident light L11 which has entered the lower section 31D is suitable for forming a portion of the low-beam light distribution pattern LP comprising a light distribution pattern which is condensed narrowly in the vertical direction. On the other hand, first incident light L11 which has entered the upper section 31U is suitable for forming a portion of the low-beam light distribution pattern LP comprising a light distribution pattern which is diffused broadly in the vertical direction.

(Description of Examples Other than the Embodiment)

In the present embodiment the main light distribution pattern is a low-beam light distribution pattern. However, in the present invention the main light distribution pattern may be a light distribution pattern other than the low-beam light distribution pattern LP, for example a fog light distribution pattern or a cornering light distribution pattern.

Also, in the present embodiment, as shown in FIG. 5 the second surface of incidence 32 is located on the semiconductor light source 2 side of an imaginary first surface of incidence 310 which is an extension of the first surface of incidence 31. However, in the present invention it is also possible to provide a step to the emission surface 30 side at the starting point (starting line) 33, and to provide a second surface of incidence 32 the location of which lies further toward the semiconductor light source 2 side with increasing distance from the first surface of incidence 31. In this case the second surface of incidence 32 need not be located on the semiconductor light source 2 side of the imaginary first surface of incidence 310.

EXPLANATION OF THE REFERENCE NUMBERS

1 Vehicle lamp fitting
2 Semiconductor light source
20 Light-emitting chip
21 Light-emitting surface
3 Lens
30 Emission surface
31 First surface of incidence
31U Upper section
31D Lower section
310 Imaginary first surface of incidence
32 Second surface of incidence
33 Starting point (starting line)
4 Heat sink member (attachment member)
40 Attachment portion
41 Fin portion
F Reference focal point of lens
HL-HR Horizontal left-right line on screen
L1 Light from semiconductor light source
L11 First incident light
L12 Second incident light
L21 First emitted light
L22 Second emitted light
L110 First imaginary incident light
L210 First imaginary emitted light
LP Low-beam light distribution pattern
N1 First normal line
N2 Second normal line
O Center of light-emitting chip
OSP Overhead sign light distribution pattern
VU-VD Vertical up-down line on screen
X X axis
Y Y axis
Z Reference optical axis of lens (Z axis)
θ1 First angle of incidence
θ2 Second angle of incidence

The invention claimed is:

1. A vehicle lamp fitting comprising:

a semiconductor light source including a reference focal point at or in a vicinity of a center of at least one light-emitting surface, and upon receiving electrical current, the semiconductor light source emits a first portion of light and a second portion of light from the at least one light-emitting surface; and a lens including at least a first surface of incidence and a second surface of incidence facing the at least one light-emitting surface, and at least one emission surface opposite the first and second surfaces of incidence;

wherein the second surface of incidence lies further toward the semiconductor light source than an extended first surface of incidence, defined as a location of the first surface of incidence if the first surface of incidence was to be extended beyond a starting point of the second surface of incidence;

wherein the first portion of light is emitted at or in a vicinity of the reference focal point from the at least one light-emitting surface, enters the first surface of incidence of the lens directly from the at least one light-emitting surface, and is shaped or redirected as it passes through the lens as first incident light, the first incident light exiting the lens via the at least one emission surface as a main light distribution pattern;

wherein the second portion of light is emitted at or in a vicinity of the reference focal point from the at least one light-emitting surface, enters the second surface of incidence of the lens directly from the at least one light-emitting surface, and is shaped or redirected as it passes through the lens as second incident light, the second incident light exiting the lens via the at least one emission surface as an overhead sign light distribution pattern; and wherein a shape of the first surface of incidence and a shape of the second surface of incidence are each selected from a group consisting of: a free-form surface, a compound quadratic surface, and an aspherical surface.

2. The vehicle lamp fitting of claim 1, wherein a distance between the second surface of incidence and the extended first surface of incidence increases with increasing distance from the first surface of incidence.

3. The vehicle lamp fitting of claim 1, wherein the second surface of incidence is located above the first surface of incidence.

4. The vehicle lamp fitting of claim 1, wherein the first surface of incidence and the second surface of incidence are shaped such that the first portion of light and the second portion of light can enter the lens directly from the at least one light-emitting surface without the first portion of light and the second portion of light being redirected toward the lens by a parabolic reflective surface.

5. The vehicle lamp fitting of claim 1, wherein the at least one light-emitting surface of the semiconductor light source faces in the direction of a reference optical axis of the lens.

6. The vehicle lamp fitting of claim 1, wherein an upper section of the first surface of incidence is shaped to diffuse a first part of the first portion of light broadly in a vertical direction, and a lower section of the first surface of incidence is shaped to condense a second part of the first portion of light in the vertical direction.

* * * * *